US009980067B2

(12) United States Patent
Dorn

(10) Patent No.: US 9,980,067 B2
(45) Date of Patent: May 22, 2018

(54) HEARING DEVICE WITH A WAX GUARD, AND WAX GUARD

(71) Applicant: SIVANTOS PTE. LTD., Singapore (SG)

(72) Inventor: Theo Dorn, Osnabrueck (DE)

(73) Assignee: Sivantos Pte, Ltd., Singapore (SG)

( * ) Notice: Subject to any disclaimer, the term of this patent is extended or adjusted under 35 U.S.C. 154(b) by 0 days. days.

(21) Appl. No.: 15/066,131

(22) Filed: Mar. 10, 2016

(65) Prior Publication Data

US 2016/0269840 A1 Sep. 15, 2016

(30) Foreign Application Priority Data

Mar. 10, 2015 (DE) ..... 10 2015 204 250

(51) Int. Cl.
*H04R 25/00* (2006.01)

(52) U.S. Cl.
CPC ..... *H04R 25/654* (2013.01); *H04R 25/65* (2013.01); *H04R 25/658* (2013.01); *H04R 2225/023* (2013.01); *H04R 2225/025* (2013.01)

(58) Field of Classification Search
CPC ..... H04R 2201/003; H04R 25/654; H04R 2225/025; H04R 25/10; H04R 1/12; H04R 25/02; H04R 1/1066; H04R 1/1016; H04R 1/023; H04R 2460/17; H04R 1/1075
USPC ..... 381/325
See application file for complete search history.

(56) References Cited

U.S. PATENT DOCUMENTS 4,553,627 A * 11/1985 Gastmeier ..... H04R 25/654 128/864
4,972,488 A * 11/1990 Weiss ..... H04R 25/654 381/322
5,166,659 A 11/1992 Navarro
5,185,802 A * 2/1993 Stanton ..... H04R 25/60 181/129
5,712,918 A * 1/1998 Yoest ..... H04R 25/654 181/130
6,135,235 A * 10/2000 Brimhall ..... H04R 25/654 181/129

(Continued)

FOREIGN PATENT DOCUMENTS

DE 102010013447 A1 * 6/2011 ..... H04R 1/12
JP 2005252420 A 9/2005

(Continued)

*Primary Examiner* — Oyesola C Ojo
(74) *Attorney, Agent, or Firm* — Laurence A. Greenberg; Werner H. Stemer; Ralph E. Locher

(57) ABSTRACT

A hearing device contains a hearing device housing, which is insertable into an auditory canal of a person wearing the hearing device and which has a through-opening leading to the interior of the hearing device housing. The hearing device has a wax guard which is inserted into the through-opening and serves to protect against dirt, and wax, entering the hearing device housing. The guard contains a filter housing, which carries a filter element. At least one aperture is formed in a peripheral wall of the filter housing, which peripheral wall, in the correct insertion state, faces toward a peripheral wall of the hearing device housing delimiting the through-opening, and, in order to carry way and/or take up dirt, the aperture communicates with at least one hollow space arranged in the hearing device housing.

10 Claims, 2 Drawing Sheets

(56) References Cited

U.S. PATENT DOCUMENTS

| | | | | |
|---|---|---|---|---|
| 7,013,016 | B2 * | 3/2006 | Wolf | H04R 25/654 381/324 |
| 9,456,287 | B2 * | 9/2016 | Lindebjerg | H04R 25/654 |
| 2007/0009106 | A1 * | 1/2007 | Tilson | H04R 25/654 381/60 |
| 2008/0118095 | A1 * | 5/2008 | Fletcher | H04R 25/654 381/328 |
| 2010/0040250 | A1 | 2/2010 | Gebert | |
| 2011/0299712 | A1 * | 12/2011 | Bondo | H04R 25/654 381/325 |
| 2014/0193012 | A1 * | 7/2014 | Lindebjerg | H04R 25/608 381/328 |
| 2016/0057528 | A1 * | 2/2016 | Trine | H04R 25/654 381/380 |
| 2016/0165334 | A1 * | 6/2016 | Grossman | H04R 1/023 381/328 |

FOREIGN PATENT DOCUMENTS

| | | | | |
|---|---|---|---|---|
| JP | 2008301306 | A | 12/2008 | |
| JP | 2009200670 | A * | 9/2009 | H04R 25/00 |

* cited by examiner

HEARING DEVICE WITH A WAX GUARD, AND WAX GUARD

CROSS-REFERENCE TO RELATED APPLICATION

This application claims the priority, under 35 U.S.C. § 119, of German application DE 10 2015 204 250.2, filed Mar. 10, 2015; the prior application is herewith incorporated by reference in its entirety.

BACKGROUND OF THE INVENTION

Field of the Invention

The invention relates to a hearing device with a wax guard, and to a wax guard for a hearing device. The hearing device is in particular a hearing aid, which allows users with impaired hearing to perceive sounds normally. However, the field of use of the invention also covers hearing devices for users with normal hearing, e.g. in-ear headphones.

A hearing device typically contains a housing which is at least partially insertable into an auditory canal of a person wearing the hearing device (or "user"). To differentiate it from other housings, this housing is referred to herein below by the expression "hearing device housing". If the hearing device housing is adapted to the specific anatomy of the auditory canal of the user, the housing is in most cases referred to as an "ear mold".

At least one sound generator ("receiver", "loud-speaker") is in most cases accommodated in the hearing device housing and serves to ensure that noises, which in the case of a hearing aid are received for example by an integrated microphone, are conveyed through a sound outlet channel of the hearing aid housing into the auditory canal of the user.

A guard is typically provided to protect the sound generator from damage caused by dirt that could enter the hearing aid housing through the sound outlet channel. The guard is often in the form of an exchangeable filter insert, which is inserted exchangeably into the sound outlet channel of the hearing device housing. On account of the position of the hearing device housing in the auditory canal, the dirt that is to be held back is for the most part in the form of cerumen (nontechnical name "earwax") or sweat. The guard is therefore also referred to as a wax guard.

A guard of this kind for a sound inlet channel of a hearing device is known from U.S. patent publication No. 2014/0193012 A1, for example. In conjunction with a stepped design of the sound inlet channel, this guard creates a meandering course of a sound inlet opening, as a result of which dirt is intended to be prevented from entering the sound inlet channel.

By contrast, a guard for a sound outlet channel of a hearing device is known from U.S. Pat. No. 4,972,488. In the guard according to U.S. Pat. No. 4,972,488, projections are provided in a housing interior of the guard, which projections, on the one hand, serve to modify the sound guided through the housing interior and, on the other hand, act as collecting zones for dirt entering the housing interior.

SUMMARY OF THE INVENTION

The object of the invention is to make available a hearing device (in particular a hearing aid) with a particularly effective wax guard. The invention has the further object of making available a wax guard for a hearing device (in particular a hearing aid) providing particularly effective protection.

The hearing device according to the invention contains a hearing device housing, which is insertable into an auditory canal of a person (user) using the hearing device. An interior of the hearing device housing accommodates in particular at least one electronic component of the hearing device, typically a sound generator or loudspeaker (also referred to as a "receiver" of the hearing device). The hearing device housing has a through-opening leading from the interior of the housing to the outside. The through-opening is configured in particular as a sound outlet channel through which sound from the sound generator is conveyed into the auditory canal of the user.

For protection, in particular of the components accommodated in the hearing device housing, from dirt entering the hearing device housing via the through-opening, a guard is inserted or insertable into the through-opening. The guard is in particular configured as a replacement part separate from the hearing device housing.

The guard contains a filter housing, which is configured to carry a filter element that provides the actual protective function of the guard, such that the filter element, in the inserted state, provides a protective closure of the through-opening. The dirt that is to be held back by the guard is, in particular, wax. The guard is therefore also referred to as a wax guard.

The filter housing, which is configured for example in a ring shape or a can shape (i.e. in the form of a hollow cylinder at least partially closed at both ends), is adapted in terms of its dimensions to the through-opening, in order to ensure that it sits in the through-opening with as exact a fit as possible. When the guard is inserted as intended into the through-opening of the hearing device housing, a peripheral wall of the filter housing, which forms the outer circumference of the filter housing and encloses a housing interior of the filter housing, faces toward a wall surface of the hearing device housing delimiting the through-opening. In other words, the peripheral wall lines, at least for the most part, the wall surface delimiting the through-opening and, in an expedient embodiment, bears in particular on this wall surface. In its areal extent, the peripheral wall of the filter housing is preferably oriented at least approximately parallel to an axis of the through-opening (and thus to the direction of entry of dirt).

According to the invention, at least one aperture is formed in this peripheral wall and communicates with at least one hollow space arranged in the hearing device housing. The hollow space serves to carry away and/or take up dirt (in particular wax) that is conveyed through the aperture out of the filter housing. Preferably, a plurality of apertures is formed in the peripheral wall, wherein each aperture communicates with a hollow space of the hearing aid device.

The term "communicates" is to be understood here as meaning that an opening in the hearing device housing leading to the hollow space is arranged with respect to the correctly inserted guard in such a way that, by the aperture, a fluidic connection is present between the interior of the filter housing and the hollow space. In the hearing device according to the invention, this advantageously has the effect that wax or other dirt entering the filter housing is diverted laterally through the or each aperture and is conveyed to the hollow space. In this way, the dirt is particularly effectively kept safely away from the component optionally present in the hearing device housing. At the same time, this counteracts blockage of the guard.

The hearing device according to the invention is distinguished by providing highly effective protection and thus advantageously by having a particularly high degree of robustness, a relatively long useful life, and by not being likely to need repair. These advantages are seen particularly under outdoor conditions in which the user of the hearing device regularly perspires greatly (e.g. when in a warm and humid climate or when carrying out frequent sporting activities).

In a first embodiment, provision is made that the hollow space is formed by a collecting chamber which is formed in the hearing device housing. The hollow space is in this case a (collecting) chamber which is open toward the aperture but which is otherwise closed, and in which wax or other dirt gradually accumulates. The collecting chamber can be emptied when replacing the guard and cleaning the hearing device housing. In a preferred embodiment, the or each collecting chamber is formed integrally in a housing wall of the hearing device housing.

In the context of the invention, a single collecting chamber can be provided, which is in communication with each of the apertures. Such a collecting chamber is configured in particular as an annular chamber extending about the through-opening and the guard. However, it is also possible, within the context of the invention, that several receiving chambers separate from each other are provided.

In an alternative embodiment, the hollow space is formed by a connection channel which, starting from the wall surface delimiting the through-opening, opens toward an outer face of the hearing device housing. In this case, the wax diverted from the interior of the filter housing is carried off through the connection channel and is at least partially released via the outer face of the hearing device housing. Preferably, a separate connection channel is present for each aperture of the filter housing and is fluidically connected to the respectively assigned aperture.

Even if, for reasons of simplicity, only one or more collecting chambers or only one or more connection channels are provided in the hearing device housing, the invention in principle also covers embodiments in which the hearing device housing has at least one collecting chamber and at least one connection channel in combination.

In order to ensure a correct assignment of the or each collecting chamber or the or each connection channel to the or each corresponding aperture (i.e. to ensure a flush arrangement of collecting chambers or connection channels and the respectively corresponding apertures), corresponding means are preferably provided on the guard and the hearing device housing, which means ensure a defined relative position of the guard with respect to the hearing device housing. Such means (also acting to prevent rotation) are provided, for example, in the form of a tongue-and-groove arrangement.

Starting from the through-opening, the or each connection channel preferably extends obliquely outward in the direction of an end of the hearing device housing arranged at the auditory canal side during the intended use. The extent in particular includes a curvature. In a particularly preferred embodiment, the connection channel widens conically from its housing interior end (at the aperture of the filter housing) to its end at the outer face of the housing, such that a backward flow of liquid substances (sweat, wax) counter to the intended drainage direction is suppressed.

A (wax) guard according to the invention for a hearing device as described above contains a filter housing, which has at least one aperture formed in its peripheral wall, which aperture communicates with a hollow space formed in the hearing device housing when the wax guard is inserted as intended into a through-opening of a hearing device housing.

Each aperture is preferably formed in the peripheral wall of the filter housing as a recess open at one end (i.e. like a crenellation), which recess is open toward an edge of the peripheral wall directed away from the filter element. In the case of a substantially cylindrical (annular) peripheral wall, each aperture is introduced into the peripheral wall in particular as a slit passing radially through the peripheral wall and extending approximately along an axial direction.

In a development of the abovementioned invention, the filter insert contains at least two filter elements, which are arranged in series in the filter housing. The filter element is in particular provided in the form of a sheet of filter medium, preferably a filter gauze, a filter membrane or a (metallic) screen. Preferably, both or all of the filter elements are identical. However, combinations of different filter elements are also conceivable within the context of the invention.

By virtue of the proposed arrangement of at least two filter elements connected in series, as seen in the direction of potential entry of dirt, a particularly effective wax guard is obtained. The resulting barrier effect provided by a guard with this design is enhanced especially with respect to liquid substances. Moreover, the sequential arrangement affords an advantageous redundancy, such that, if the first filter element sustains damage, it is possible to resort to the second filter element as barrier.

In an embodiment that is advantageous from the point of view of a reliable fit and a sealing action, the filter housing tapers conically at its front end which, during the intended use, faces toward the interior of the hearing device housing.

The use of the above-described wax guard also provides already improved wax protection per se, in particular also of the guards in which the filter housing is not provided with the above-described apertures for carrying off the wax and/or in hearing devices that are not provided with corresponding hollow spaces to take up or carry off wax and other dirt. To this extent, a guard which is provided in the above-described manner with two filter elements arranged sequentially in the filter housing, and optionally with a filter housing tapering conically to the inside, is also regarded as an independent invention.

The inventive design of the hearing device housing, and of the corresponding guard, has a particularly preferable use in an in-the-ear hearing aid or in a hearing aid shell for an external receiver of a behind-the-ear hearing aid. However, the invention further extends to the use of the guard in in-ear headphones, for example.

Other features which are considered as characteristic for the invention are set forth in the appended claims.

Although the invention is illustrated and described herein as embodied in a hearing device with a wax guard, and a wax guard, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 FIG. 1 is a diagrammatic, perspective cross-sectional view of the hearing aid according to a second embodiment in which connection channels are formed in the hearing device housing and, in order to carry wax away, communicate with the lateral apertures in the guard;

DETAILED DESCRIPTION OF THE INVENTION

Figure 1:
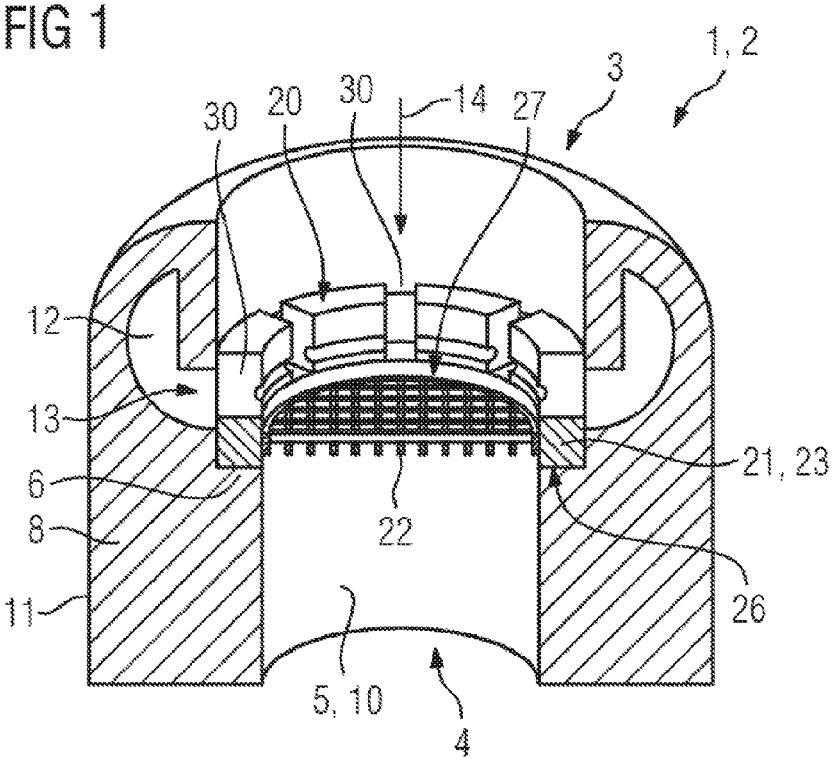
FIG. 1 is a diagrammatic, perspective cross-sectional view of an end of a hearing aid at an auditory canal side, with a hearing device housing containing a sound outlet opening into which a (wax) guard is fitted, wherein an annular hollow chamber is formed in the hearing device housing and, in order to receive wax, communicates with lateral apertures in the guard.

Parts corresponding to each other are always provided with the same reference signs in all of the figures.

Referring now to the figures of the drawings in detail and first, particularly to FIG. 1 thereof, there is shown a portion of a hearing aid 1 containing a (hearing device) housing 2, which is insertable into an auditory canal of a person using the hearing aid 1 (who is referred to hereinafter simply as the "user"). In the portion shown, the housing 2 has a substantially cylindrical configuration, corresponding to the auditory canal. An end 3 of the housing 2 at the auditory canal side has a rounded shape. A non-illustrated sound generator is accommodated in an interior 4 of the housing 2. The sound generated by it is conveyed from the interior of the housing 2 outward (into the auditory canal of the user) via a sound outlet channel 5.

The sound outlet channel 5 has a tubular shape, with its diameter widening toward the end 3 in one step 6. The sound outlet channel 5 is encased by a housing wall 8 of the housing 2, which housing wall 8 delimits the sound outlet channel 5 with a wall surface 10. A side of the housing wall 8, or of the housing 2, facing toward the ear or auditory canal is designated as an outer face 11.

Near the end 3, an annular chamber 12 radially surrounding the sound outlet channel 5 is formed in the housing wall 8, which annular chamber 12 undercuts the wall surface 10 toward the end 3. A circumferential gap 13, introduced into the wall surface 10 at a short distance from the step 6, forms the sole access to the annular chamber 12.

To protect the sound generator from damage ("blockage") caused by dirt (wax, sweat, skin particles), which could enter the housing 2 along a direction 14 of entry of dirt (along the axis of the sound outlet channel), an exchangeable (wax) guard 20 is inserted into the sound outlet channel 5 on the auditory canal side.

Figure 2:
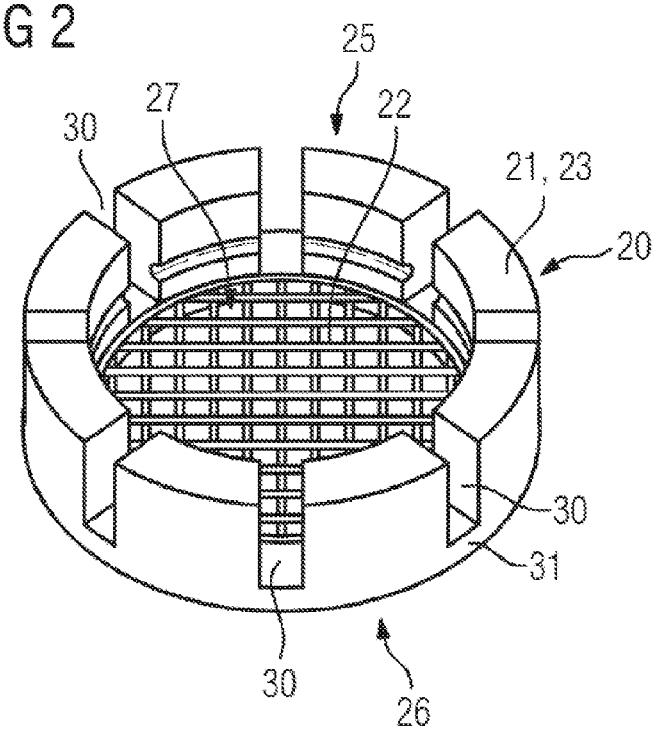
FIG. 2 is a perspective view of the guard of the hearing aid according to FIG. 1.

The guard 20, shown in detail in FIG. 2, contains a filter housing 21, and also a filter element 22 that at least substantially holds back wax and other dirt. The filter housing 21 is formed substantially by an annular peripheral wall 23 made of plastic. The peripheral wall 23 approximately forms a hollow cylinder or a (short) tube, of which the first axial end (designated as front end 25) faces toward the auditory canal during intended use, whereas the second axial end (designated as front end 26) faces toward the sound generator during intended use. A space enclosed by the peripheral wall 23 is designated as a housing interior 27 of the filter housing 21.

The filter element 22 is held on a front end 26 by the filter housing 21. For this purpose, during the course of production of the guard 20, the filter element 22 is integrated in the peripheral wall 23 by injection molding, casting or forming.

The filter element 22 is formed here in a conventional manner by an approximately circular sheet of filter gauze. Alternatively, the filter element 22 is formed by a (metallic) screen or a sound-transmitting membrane.

The peripheral wall 23 is crossed by several radial apertures 30 which are arranged at uniform intervals about the periphery and which are formed in the peripheral wall 23 as approximately rectangular recesses open toward the free end 25. The peripheral wall 23 is only partially interrupted over its height, such that the peripheral wall 23, at the fixed end 26, has an edge 31 that is closed all the way about its circumference. This edge 31 of the peripheral wall 23 at the fixed end ensures a sufficient stability of the filter housing 21 for insertion and removal of the guard 20. In order to insert and remove the guard 20, an internal thread is additionally formed in the peripheral wall 23, by which the guard 20 can be screwed onto a corresponding mounting tool. The height of the filter housing 21 is small compared to its diameter.

When the guard 20 (as shown in FIG. 1) is inserted as intended into the sound outlet channel 5 of the hearing device housing 2, the fixed end 26 sits on the step 6, wherein the peripheral wall 23 of the filter housing 21 bears with an exact fit on the wall surface 10 of the housing wall 8. The peripheral wall 23 is thus oriented coaxially with the longitudinal direction of the sound outlet channel 5. By virtue of the exact fit, the guard 20 is held in the sound outlet channel 5 in a manner safe against loss. However, it is also conceivable within the scope of the invention that the guard 20 is screwed into the sound outlet channel 5. An edge of the peripheral wall 23 at the free end and the undercut area of the inner face 10 overlap each other partially in the axial direction. On the other hand, the apertures 30 and the annular gap 13 also partially overlap.

By virtue of this arrangement, dirt entering the housing interior 27 along the direction 14 of entry of dirt (i.e. counter to a sound outlet direction) is guided through the apertures 30 and the annular gap 13 into the annular chamber 12 and is collected in this collecting zone. In this case, the annular chamber 12 constitutes a hollow space communicating with the apertures 30. If necessary, the annular chamber 12 is cleaned and emptied.

Figure 3:
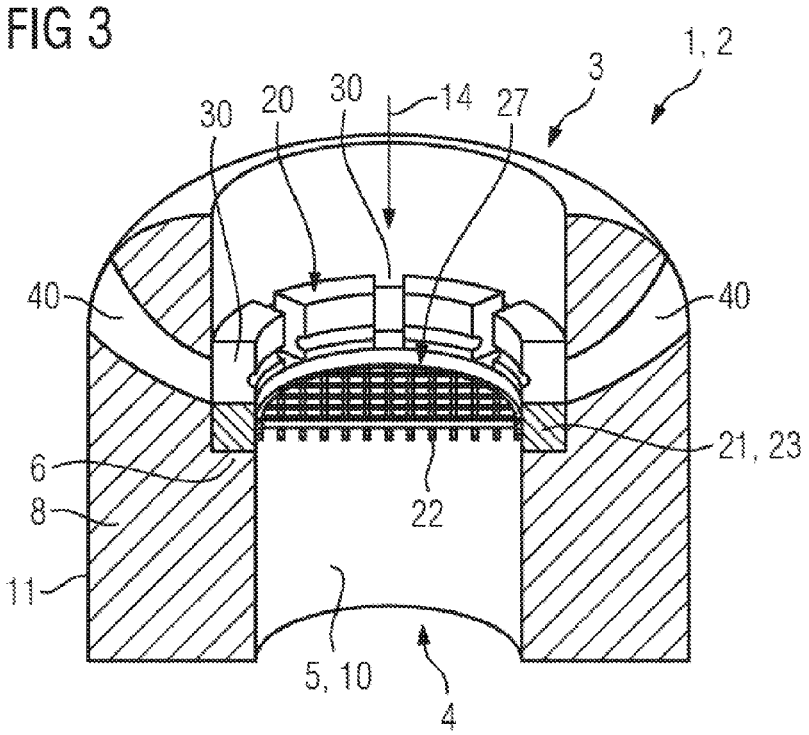

FIG. 3 shows the auditory-canal-side portion of the hearing aid 1 according to a second embodiment, which corresponds substantially to the first embodiment. However, in contrast to the first embodiment, the annular chamber 12 is replaced by a connection channel 40 introduced into the housing wall 8 for each aperture 30. Each connection channel 40 in turn constitutes a hollow space that communicates with one of the apertures 30. Each connection channel 40 passes through the housing wall 8 from the wall surface 10 to the outer face 11. Each connection channel 40 initially runs almost radially away from the aperture 30 and thereafter curves in the direction of the end 3. In doing so, each connection channel 40 widens conically from the wall surface 10 toward the outer face 11.

Figure 4:
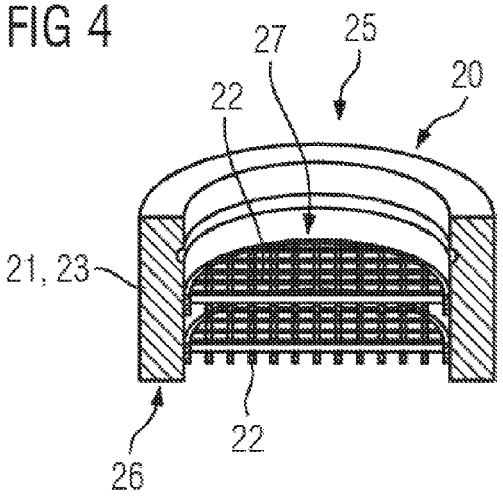
FIG. 4 is a cross-sectional view of the guard on its own, in the second embodiment in which the guard comprises two filter elements connected in series.

FIG. 4 shows the guard 20 in a cross-sectional view. The guard 20 is configured substantially the same as the guard according to FIG. 2. However, in contrast to the latter, the guard 20 here contains a double filter element 22. Both filter elements 22 are identical, for example configured as a filter gauze. Both filter elements 22 are approximately plane-parallel and are mounted at a short distance from each other in the area of the fixed end 26 by means of the peripheral wall 23.

Figure 5:
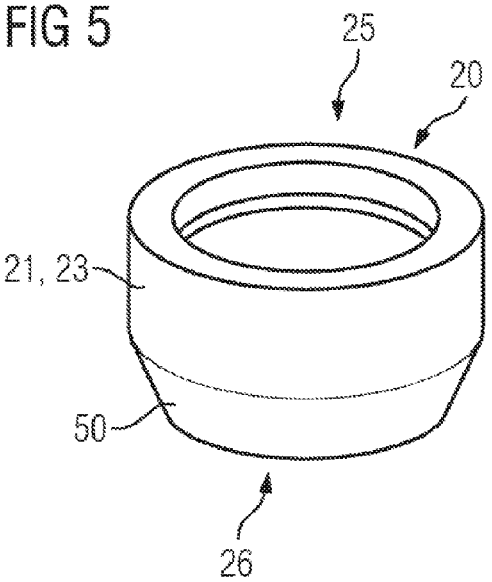
FIG. 5 is a diagrammatic, perspective view showing the guard on its own in a further embodiment in which the guard tapers conically toward a fixed end.

FIG. 5 shows a guard 20 in which the filter housing 21 is provided with a bevel 50 to the fixed end 26. By virtue of the filter housing 21 being conically tapered, the filter housing 21 is fixed particularly efficiently and sealingly in the hearing device housing 2.

The peripheral wall 23 is shown without apertures 30 in each of FIG. 4 and FIG. 5. Even in this form, the use of the guard 20 according to FIG. 4 or 5, on account of the double filter element 22, provides an improvement in the robustness of a hearing aid 1 provided with it. However, in the preferred embodiment, the guard 20 is provided both with the double filter element 22 according to FIG. 4 or 5 and also with apertures 30 according to FIGS. 1 to 3.

The subject matter of the invention is not limited to the illustrative embodiments described above. Rather, further embodiments of the invention can be derived from the claims and from the above description. In particular, the individual features explained with reference to FIGS. 1 to 5 can be combined with one another as desired within the scope of the claims, without departing from the invention.

The invention claimed is:

1. A hearing device, comprising:

a hearing device housing being insertable into an auditory canal of a person wearing the hearing device and having a through-opening formed therein and leading to an interior of said hearing device housing;

an exchangeable guard inserted into said through-opening and protecting against dirt entering said hearing device housing, said guard containing a filter housing and a filter element disposed in said filter housing, said filter housing having an annular shape open on both axial sides and a peripheral wall with at least one aperture formed therein, said peripheral wall enclosing a filter housing interior of said filter housing and, in a correct insertion state, faces toward a wall surface of said hearing device housing delimiting said through-opening; and said hearing device housing having at least one hollow space formed therein for carrying away and/or taking up the dirt, said wall surface having an access formed therein and leading to said hollow space, and a fluidic connection between said filter housing interior of said filter housing and said hollow space being formed by said aperture, when said guard is inserted, the dirt is guided through said aperture out of said filter housing interior into said hollow space.

2. The hearing device according to claim 1, wherein said hollow space is formed by a collecting chamber open toward said aperture.

3. The hearing device according to claim 2, wherein said collecting chamber is formed as an annular chamber that radially surrounds said through-opening.

4. The hearing device according to claim 1, wherein said hollow space is formed by a connection channel which, starting from said wall surface, leads to an outer face of said hearing device housing.

5. The hearing device according to claim 4, wherein said connection channel extends obliquely in a direction of an end of said hearing device housing disposed at an auditory canal side during intended use.

6. The hearing device according to claim 4, wherein said connection channel has an inner end and an outer end, said inner end widens conically towards said outer end.

7. An exchangeable wax guard for a hearing device, the hearing device having a hearing device housing with a through-opening formed therein and a hollow space formed therein, the hollow space being formed by a connection channel which, starting from an inner wall surface of the hearing device housing, leads to an outer face of the hearing device housing, the connection channel extending obliquely in a direction of an end of the hearing device housing disposed at an auditory canal side during intended use, the wax guard comprising:

a filter housing having an annular shape open on both axial sides and a peripheral wall with at least one aperture formed therein, said peripheral wall enclosing a filter housing interior of said filter housing, said aperture communicating with the hollow space formed in the hearing device housing, such that dirt is guided through said aperture out of said filter housing interior into the hollow space when the wax guard is inserted into the through-opening of the hearing device housing.

8. The wax guard according to claim 7, wherein said aperture is introduced into said peripheral wall as a recess open at one end.

9. The wax guard according claim 7, further comprising at least two filter elements connected in series in a direction of entry of the dirt.

10. The wax guard according to claim 7, wherein said filter housing tapers conically at a front end which, during intended use, faces toward an interior of the hearing device housing.

* * * * *